US005823750A

United States Patent [19]

Hoffmann et al.

[11] Patent Number: 5,823,750

[45] Date of Patent: Oct. 20, 1998

[54] HOUSING ARRANGEMENT FOR AN EXTERNAL ROTAR DRIVEN LUBRICATING PUMP

[75] Inventors: Kurt Hoffmann, Bad Schussenried; Franz Maucher, Bad Waldsee, both of Germany

[73] Assignee: Schwabische Huttenwerke GmbH, Aalen-Wasseralfingen, Germany

[21] Appl. No.: 561,927

[22] Filed: Nov. 22, 1995

[30] Foreign Application Priority Data

Nov. 22, 1994 [DE] Germany ..... 44 41 522.2

[51] Int. Cl.[6] ..... F04C 2/10

[52] U.S. Cl. ..... 417/310; 417/362; 418/171; 418/144

[58] Field of Search ..... 417/362, 364, 417/440, 310; 418/166, 171, 144

[56] References Cited

U.S. PATENT DOCUMENTS

| | | | |
|---|---|---|---|
| 2,792,788 | 5/1957 | Eames, Jr. | 418/171 |
| 3,407,741 | 10/1968 | Weber et al. | 418/166 |
| 4,185,717 | 1/1980 | Ford, Jr. et al. | 418/171 |
| 4,432,712 | 2/1984 | Eisenmann | 418/171 |
| 5,395,217 | 3/1995 | Hoffmann et al. | 417/362 |

FOREIGN PATENT DOCUMENTS

| | | | |
|---|---|---|---|
| 2243874 | 11/1991 | European Pat. Off. | 418/166 |
| 3243067 A1 | 5/1984 | Germany . | |
| 3603773 A1 | 7/1987 | Germany . | |
| 3821162 | 8/1989 | Germany | 418/144 |
| 4123190 A1 | 12/1992 | Germany . | |
| 4214752 | 11/1993 | Germany | 418/166 |
| 183583 | 11/1982 | Japan | 418/166 |
| 2223275 | 4/1990 | United Kingdom | 418/171 |

*Primary Examiner*—Timothy Thorpe
*Assistant Examiner*—Ted Kim
*Attorney, Agent, or Firm*—Ratner & Prestia

[57] ABSTRACT

An external-rotor-driven lubricating pump comprising a lubricant guidance part including a suction port, an outer wall, a carrier section, a discharge port, a lubricant feed space disposed between the carrier section and the outer wall and connected with the suction port, with a lubricant delivery space disposed between the carrier section and the outer wall and connected with the discharge port, and a pump part including a drive gear, an internally-toothed external rotor, with an externally-toothed internal rotor having one tooth less than the number of teeth on the external rotor, the external rotor and the internal rotor upon meshing pumping the lubricant from the lubricant feed space into the lubricant delivery space, with a shaft supporting the drive gear in the carrier section, the drive gear being fixed to the external rotor, the drive gear forming together with the external rotor the outer closure of the lubricating pump at its pump part end, with the internal rotor being mounted loosely on a collar of the carrier section.

20 Claims, 1 Drawing Sheet

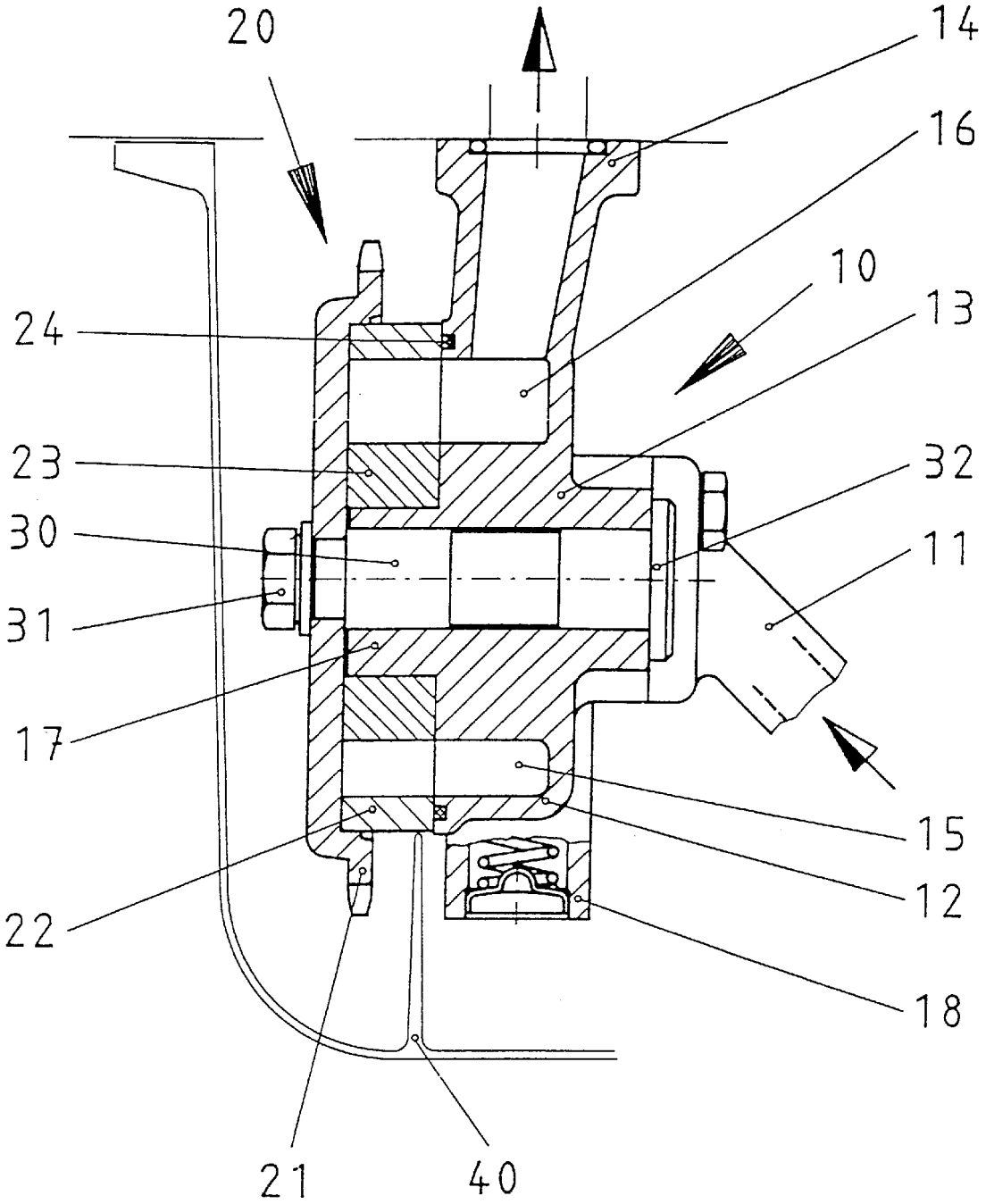
20
14
16
10
13
24
23
32
30
11
31
17
15
12
22
18
21
40

HOUSING ARRANGEMENT FOR AN EXTERNAL ROTAR DRIVEN LUBRICATING PUMP

FIELD OF THE INVENTION

The invention relates to an external rotor driven lubricating pump of the kind as specified in the preamble of claim 1.

BACKGROUND OF THE INVENTION

External rotor driven lubricating pumps are known and comprise in general a housing which as a stationary component includes means for the feed and delivery of the lubricant and together with a cover mounted on the side of a drive gear closes off the pump from the environment on all sides. Due to the afore-mentioned design of the metallic housing the drawback of such pumps is their relatively high weight which is hardly compatible with current lightweight motor vehicle design. A further drawback of pumps of the kind specified is the fact that there is no avoiding having to mount the rotating components of the pump in the housing, resulting in an increase in friction and thus in energy or fuel consumption.

From the German laid-open patent application DE 36 03 773 A1 an external rotor driven pump is known, having a cup-shaped internal drive gear which totally accommodates the external rotor and covers it together with a flange plate mounted on a slide bearing on the housing of the pump. The drawback of this pump involves in turn that friction occurs at the housing at the bearing locations of the end flange and that the cup-shaped drive gear totally accommodating the external rotor substantially increases the overall weight of the pump.

From the German laid-open patent application no. 32 43 067 A1 an internal rotor gear-type oil pump for motor vehicle internal combustion engines is also known, which features a heavy housing totally enclosing the two rotors.

The German laid-open patent application DE 41 23 190 A1 describes an external rotor driven pump which is arranged in a drive gear or in a guide pulley of the internal combustion engine; the external rotor is driven by the drive gear or the guide pulley.

Here too, the pump described has the drawback that the external rotor is totally surrounded by the drive gear, the former being mounted on a stationary component by means of a rotative seal, again a design which involves high weight and high friction losses.

SUMMARY OF THE INVENTION

The object of the present invention is to provide an external rotor driven lubricating pump which avoids the above drawbacks and has a relatively low weight whilst minimizing the friction losses.

BRIEF DESCRIPTION OF THE DRAWING

The single figure of the drawing is a fragmentary cross-sectional view of a lubricating pump according to the invention.

DETAILED DESCRIPTION OF THE INVENTION

In the lubricating pump according to the invention the external rotor together with the drive gear form the outer closure of the pump end of the lubricating pump.

By this design, configuring a housing to totally surround the pump or a drive gear cup-shaped to accomodate the external rotor becomes unnecessary since the external rotor which is fixedly connected to the drive gear defines the outside of the pump itself and thus takes on the function of the housing itself as a substantial property.

Now, the drive gear needs only to be configured large and complicated enough to form together with the external rotor a sealed outer closure of the pump which advantageously results in a remarkable weight-saving in the pump.

The housing closing off the pumps of the kind concerned may be reduced to a lubricant guidance part consituting a sliding seal for the external rotor, so that again weight can be saved.

Friction now no longer occurs in the lubricating pump according to the invention between the drive gear and a stationary part of the pump, but, as far as the external rotor is concerned, merely at the sliding surface thereof at the lubricant guidance part. The loose mount of the internal rotor on a collar of the carrier section results in the friction between the drive gear and the internal rotor being reduced to the value produced at the difference in the rotational speeds thereof.

In accordance with one preferred embodiment of the lubricating pump according to the invention, the drive gear and the external rotor may be integrally configured. There is also the possibility, however, of configuring the drive gear and the external rotor in two parts and connecting them together by friction contact or by reason of their form, i.e. positively. In this arrangement the external rotor may be mounted as a press fit with its outer surface in an internal sleeve of the drive gear. Furthermore, a welded joint as well as pin joints between drive gear and external rotor are feasible.

Connecting the external rotor to the outer wall of the lubricant guidance part may be achieved to advantage by arranging for the external rotor to contact by its end surface facing away from the drive gear the end surface facing the drive gear at the outer wall of the lubricant guidance part so that both the lubricant feed space and the lubricant delivery space are sealed off slidingly to the outside. The friction between the end surfaces may be maintained slight by configuring the surfaces accordingly, the sealing effect at these surfaces being adequate for pumps which e.g. are located in an oil sump.

To further enhance the sealing effect at the afore-mentioned surfaces and thus avoid leakage in the pressure portion of the pump as well as air being drawn into the suction portion of the pump, there is the possibility of providing a rotative seal between the end surfaces of the external rotor and the outer wall of the lubricant guidance part, which further extends the range of application of the lubricating pump according to the invention.

Malfunctioning due to excessive pressure may be avoided by providing a pressure relief valve at the lubricant guidance part of the pump according to the invention.

In one preferred embodiment the drive gear may be centered by means of a fastener bolt on the shaft supporting the drive gear in the carrier section, this representing an overall support of the pump which permits facilitated release, when, as is preferably the case, the shaft is supported by the carrier part at the side thereof facing away from the drive gear. The shaft, which preferably runs slidingly in two outer bearing surfaces in the carrier part, sets by means of the configuration and the axial dimensions of these sleeved bearings the axial play of the pump section. Shims are employed, as required, for fine or re-adjustment. Further possibilities known to the person skilled in the art are also possible of mounting and centering the drive gear on the shaft non-rotationally, by friction contact or positively.

The lubricating pump according to the present invention may be configured as usual of a metallic material, particularly aluminum.

The exceptionally low friction occuring in the lubricating pump embodied according to the invention also permits preferably configuring the lubricant guidance part from a plastic, particularly from a thermoplastic such as PA 4.6, PPS or PA 6.6 GF 30.

In a further preferred embodiment the pump part also consists of plastic, particularly a duroplastic or such as RX 655 (Vyncolit Co.) or Ridurid V 1017 (Ringsdorf Co.).

Of advantage in this respect is the further reduction in the weight of the lubricating pump as well as the possibility of easily manufacturing the external rotor together with the drive gear integrally of plastic.

The invention will now be described in more detail by means of an example embodiment with reference to the attached drawing.

The sole Figure of this drawing shows an embodiment of a lubricating pump according to the invention, arranged in an oil sump 40, comprising a lubricant guidance part 10 and a pump part 20. The pump pumps the lubricant through a suction port 11 into a lubricant feed chamber 12 and by means of the rotor set 22, 23 into a lubricant delivery chamber 16 and from there via a discharge port 14 to the place of employment.

The stationary lubricant guidance part 10 includes substantially a carrier section 13 and an outer wall 12 forming the outer closure. In the lower portion of the lubricant guidance part 10 a lubricant feed space 15 is formed between the outer wall 12 and the carrier section 13, the lubricant being drawn into the lubricant feed space 15 via the suction port 11.

Located substantially radially opposite the lubricant feed space 15 is a lubricant delivery space 16, also defined by the outer wall 12 and the carrier section 13. From the lubricant delivery space 16 the pressurized lubricant is pumped off into the discharge port 14.

The carrier section 13 features a central drilled hole through which a shaft 30 may be inserted (in the drawing from the right) until an end sleeve 32 of the shaft 30 comes into contact with the carrier section 13. This shaft 30 comprises two spaced sliding seats with which it is centered in the central hole of the carrier section 13.

In the region of the end of the shaft 30 opposite to the end sleeve 32 the shaft is again varied in diameter over a short axial length. On the thereby resulting seat of the shaft 30 a drive gear 21 provided with a central drilled hole may be mounted, after the internal rotor 23 has been located loosely on a drive-end collar of the carrier section 13 forming the bearing location of the latter. The external rotor 22 is secured to an inner sleeve of the drive gear 21. This can be e.g. by means of a press fit, as shown in the Figure, but also by any other method of achieving a connection by friction contact or positively. In mounting the external rotor 22 connected to the drive gear 21 on the afore-mentioned shaft section the free end surfaces of the external rotor 22 come into contact with the free end surfaces of the outer wall 12 of the lubricant guidance part 10 and, after the drive gear 21 has been secured and centered on the shaft 30 by means of the bolt 31, seal off both the lubricant feed space 15 and the lubricant delivery space 16 from the environment.

In this design the axial play of the rotor set 22, 23 is adjustable by suitably selecting the axial lengths of the shaft sleeves. In the example embodiment shown, a rotative seal 24 is inserted between the end surfaces of the external rotor 22 and the outer wall 12 of the lubricant guidance part 10, this seal serving at the supply end to prevent air between the end surfaces, coming into contact with each other, being drawn into the lubricant feed space 15. At the delivery end the rotative seal 24 prevents leakage of the pressurized lubricant at this end.

The internal rotor 23 has one tooth less than the internal toothing of the external rotor 22, and thus in rotation of the drive gear 21 a negative pressure is generated in the lubricant feed space 15 via the usual gear-type pump technique, resulting in lubricant being drawn into this space via the suction port 11. Upon meshing lubricant is pumped with increasing pressure into the lubricant delivery space 16, from which it may be supplied via the discharge port 14 to the location where required.

A pressure relief valve 18 protects the pump from excessive internal pressures, thus counteracting e.g. the seal 24 being ruined.

As preferred materials for the lubricant guidance part 10 and the pump part 20 metallic materials, particularly aluminum, are preferred. It is also possible, however, to form the lubricant guidance part of a plastic, particularly a thermoplastic such as PA 4.6, PPS or PA 6.6 GF 30. The pump part 20 too may be formed of a plastic, particularly a duroplastic. Preferred materials for this purpose are, for example, RX 655 manufactured by the Vyncolit Company or Ridurid V 1017 by the Ringsdorf Company.

We claim:

1. In an external rotor-driven lubricating pump of the type comprising a) a lubricant guidance part including
  a1) a suction port
  a2) an outer wall
  a3) a carrier section
  a4) a discharge port
  a5) a lubricant feed space disposed between said carrier section and said outer wall and connected with said suction port and
  a6) a lubricant delivery space disposed between said carrier section and said outer wall and connected with said discharge port and b) a pump part including
  b1) a drive gear
  b2) an internally-toothed external rotor having a radially outer part forming an outer enclosure of the pump part and
  b3) an externally-toothed internal rotor, said external rotor and said internal rotor pumping the lubricant from said lubricant feed space into said lubricant delivery space upon meshing, and c) a shaft supporting said drive gear in said carrier section the improvement comprising:

d) said internal rotor having one tooth less than said external rotor thereby defining said lubricant feed space, e) said drive gear fixed to said external rotor for rotation therewith, f) said drive gear together with said external rotor forming an outer enclosure of the lubricating pump at its pump part end, said drive gear abutting a first axial end of said external rotor and said internal rotor, said drive gear being axially spaced from said outer wall of said lubricant part;

g) said internal rotor removably mounted on a collar of said shaft carrier and;

h) means forming a seal between said external rotor and said outer wall of said lubricating part whereby air infiltration into said lubricant feed space and leaking of lubricant at said delivery space is prevented.

2. the lubricating pump as set forth in claim 1, wherein said drive gear and said external rotor are formed as a unitary structure.

3. The lubricating pump as set forth in claim 2, wherein a pressure relief valve is provided on said lubricant guidance part.

4. The lubricating pump as set forth in claim 2, wherein an end surface of said external rotor opposite to a surface of said external rotor contacting said drive gear contacts said outer wall of said lubricant guide part, and slidingly seals off both said lubricant feed space and the lubricant delivery space.

5. The lubricating pump as set forth in claim 2, wherein said drive gear is centered on said shaft by means of a fastener bolt.

6. The lubricating pump as set forth in claim 2, wherein said lubricant guidance part and said pump part are formed on a metallic material, particularly aluminum.

7. The lubricating pump as set forth in claim 1, wherein said drive gear and said external rotor are either formed in two parts and are connected to each other by of frictional contact or formed as a single element.

8. The lubricating pump as set forth in claim 7, wherein an end surface of said external rotor opposite to a surface of said external rotor contacting said drive gear contacts said outer wall of said lubricant guide part, and slidingly seals off both said lubricant feed space and the lubricant delivery space.

9. The lubricating pump as set forth in claim 7, wherein a pressure relief valve is provided on said lubricant guidance part.

10. The lubricating pump as set forth in claim 7, wherein said drive gear is centered on said shaft by means of a fastener bolt.

11. The lubricating pump as set forth in claim 7, wherein said lubricant guidance part and said pump part are formed of a metallic material, particularly aluminum.

12. The lubricating pump as set forth in claim 1, wherein an end surface of said external rotor opposite to a surface of said external rotor containing said drive gear contacts said outer wall of said lubricant guide part, and slidingly seals off both said lubricant feed space and the lubricant delivery space.

13. The lubricating pump as set forth in claim 12, wherein a seal is disposed between the end surfaces of said external rotor and said outer wall.

14. The lubricating pump as set forth in claim 12, wherein a pressure relief valve is provided on said lubricant guidance part.

15. The lubricating pump as set forth in claim 12, wherein said drive gear is centered on said shaft by means of a fastener bolt.

16. The lubricating pump as set forth in claim 12, wherein said lubricant guidance part and said pump part are formed of a metallic material, particularly aluminum.

17. the lubricating pump as set forth in claim 1, wherein a pressure relief valve is provided on said lubricant guidance part.

18. The lubricating pump as set forth in claim 1, wherein said drive gear is centered on said shaft by means of a fastener bolt.

19. The lubricating pump as set forth in claim 1, wherein said lubricant guidance part and said pump part are formed of a metallic material, particularly aluminum.

20. The lubricating pump as set forth in claim 1, wherein one of said lubricant guidance part and said pump part are formed of a plastic material.

* * * * *

UNITED STATES PATENT AND TRADEMARK OFFICE

CERTIFICATE OF CORRECTION

PATENT NO. : 5,823,750

DATED : October 20, 1998

INVENTOR(S) : Kurt Hoffmann, et. al.

It is certified that error appears in the above-identified patent and that said Letters Patent is hereby corrected as shown below:

Title page, item [54] and col. 1, line 2, delete "ROTAR" and insert--ROTOR--.

Column 1, lines 8-9, after "pump" delete "of the kind as specified in the preamble of claim 1".

Column 3, line 27, delete "12" and insert -- 15 --.

Signed and Sealed this

Ninth Day of February, 1999

*Attest:*

*Acting Commissioner of Patents and Trademarks*

*Attesting Officer*